US005800274A

United States Patent [19]

Widrick et al.

[11] Patent Number: 5,800,274

[45] Date of Patent: Sep. 1, 1998

[54] BOWLING ALLEY BUMPER SYSTEM FOR PRODUCING VISUAL EFFECTS

[75] Inventors: Kent Widrick, Castorland, N.Y.; John Madsen, Glen Allon, Va.; Winston Sanders, Chesterfield, Va.; Darrin Bryant, Richmond, Va.; Leonard Pauley, Mech, Va.

[73] Assignee: AMF Bowling, Inc., Richmond, Va.

[21] Appl. No.: 717,237

[22] Filed: Sep. 20, 1996

[51] Int. Cl.[6] ..... A63D 5/00

[52] U.S. Cl. ..... 473/54; 473/113

[58] Field of Search ..... 473/110, 113; 362/806, 811, 253

[56] References Cited

U.S. PATENT DOCUMENTS

| | | | |
|---|---|---|---|
| 3,917,264 | 11/1975 | Davidson et al. | 273/3 R |
| 4,143,411 | 3/1979 | Roberts | 362/806 |
| 4,900,024 | 2/1990 | Chandler et al. | 273/37 |
| 5,091,677 | 2/1992 | Bleich et al. | 362/811 |
| 5,181,716 | 1/1993 | Stephens | 473/113 |
| 5,449,326 | 9/1995 | File | 473/55 |
| 5,526,246 | 6/1996 | Liou | 362/806 |
| 5,559,681 | 9/1996 | Duarte | 362/806 |
| 5,584,766 | 12/1996 | File | 473/113 |

*Primary Examiner*—William M. Pierce
*Attorney, Agent, or Firm*—David E. Dougherty

[57] ABSTRACT

A bowling alley bumper system includes a pair of elongated bumpers extending along the length of an alley for guarding the gutters of a bowling alley when the bumpers are in an extended or guarding position. Each of the bumpers also includes a string of lights within a clear plastic rail which is disposed along an upper portion of the bumper. A controller is provided for pulsing the lights along each of the bumpers to produce a "chase" or other visual effect. For example, the controller may be used to illuminate the first, fourth, seventh, etc. lights in a string, followed by the illumination of the second, fifth, eighth, etc., lights, and then the third, sixth, ninth, etc., lights to give the appearance of moving down the alley. A controller may also be used to regulate the illumination of the lights across adjacent alleys.

18 Claims, 4 Drawing Sheets

BOWLING ALLEY BUMPER SYSTEM FOR PRODUCING VISUAL EFFECTS

FIELD OF THE INVENTION

This invention relates to a bowling alley bumper system wherein a bumper is moved into an extended position to prevent a bowling ball from falling into the gutter and, more particularly, to a bowling alley bumper system for producing novel visual effects.

BACKGROUND FOR THE INVENTION

Bowling alley bumper systems were designed for use by children and/or the physically handicapped, as well as others, who lack the physical coordination or strength to bowl, i.e., project a majority of the balls over the length of an alley without ending up in one of the gutters. Such systems are disclosed in the U.S. patent of Chandler et al., U.S. Pat. No. 4,900,024 and Stephens U.S. Pat. No. 5,181,716, which are both incorporated herein in their entireties by reference.

The availability of such systems, coupled with a change in demographics and business pressures, have encouraged bowling alley operators to put more emphasis on bumper bowling to encourage children to learn to bowl, attract families, and attract and provide a more challenging game to individuals who are not serious bowlers. Another approach, which is gaining in popularity, is the so-called "moonlight" bowling. In moonlight bowling, the lights of the bowling center are dimmed, and lighting above the lanes is turned off. The pins in certain areas of the alley are coated with a fluorescent dye and then illuminated with ultra-violet light to produce a soft glow, to simulate a moon-lit environment.

It is now believed that there may be a significant demand for a novel bowling alley bumper system, which includes a plurality of lights running along the gutter section of a bowling lane. It is also believed that a bumper which produces visual effects should include a number of features. For example, the pulsing of lights along the bumper should be controlled by a controller, capable of flashing on and off to music, chase up and down the lane, or merely blink on and off, as, for example, when a lane is idle. It is also desirable to provide individual lane controls and the ability to separately control a string of lights on each bumper, i.e., on each side of a lane. At other times, it is desirable to coordinate the lighting of a plurality of adjacent lanes to produce a wave effect or chase across a plurality of alleys.

In addition, a commercially-viable bumper system for producing visual effects should operate on relatively low voltage, minimize the likelihood of an electrical shock and consume as little power as possible. For example, it is presently believed that an acceptable system would operate a minimum of six lanes per 20-amp. circuit. A commercially-viable system should also minimize heat radiation in order to avoid any adverse effect on the physical dimensions of the bumpers, and be sufficiently durable to withstand repeated contact by a bowling ball. The system should also be relatively easy to install, readily serviced and manufactured and sold at a reasonable cost.

It has now been found that a bowling alley bumper system, in accordance with the present invention, provides the aforementioned desirable features.

BRIEF SUMMARY OF THE INVENTION

In essence, the present invention contemplates a bowling alley bumper system for guarding the gutters of a bowling alley and for producing visual effects along the length of an alley. The bumper system includes a pair of longitudinally extending bumpers, which are disposed along the length of the gutters, and means for moving the bumpers between a first, or guarding, position to prevent a bowling ball from falling into an adjacent gutter, and a second, or retracted, position for ordinary bowling. Each of the bumpers includes a plurality of lights therealong, as, for example, a string of LED lights, which are preferably equally spaced at a distance of about two to about five inches. Means are also provided for pulsing the lights, i.e., turning the lights on and off to produce a visual effect along the length of an alley. For example, in one embodiment of the invention, the lights will be pulsed sequentially along the length of the alley to produce a so-called "chase" effect.

A second embodiment of the invention contemplates a plurality of side-by-side lanes and a control means for controlling the pulsing of the lights in a plurality of alleys to produce a wave effect from one alley to the next.

The invention will now be described in connection with the accompanying drawings, wherein like reference numerals have been used to indicate like parts.

DESCRIPTION OF THE PREFERRED EMBODIMENT OF THE INVENTION

Figure 1:
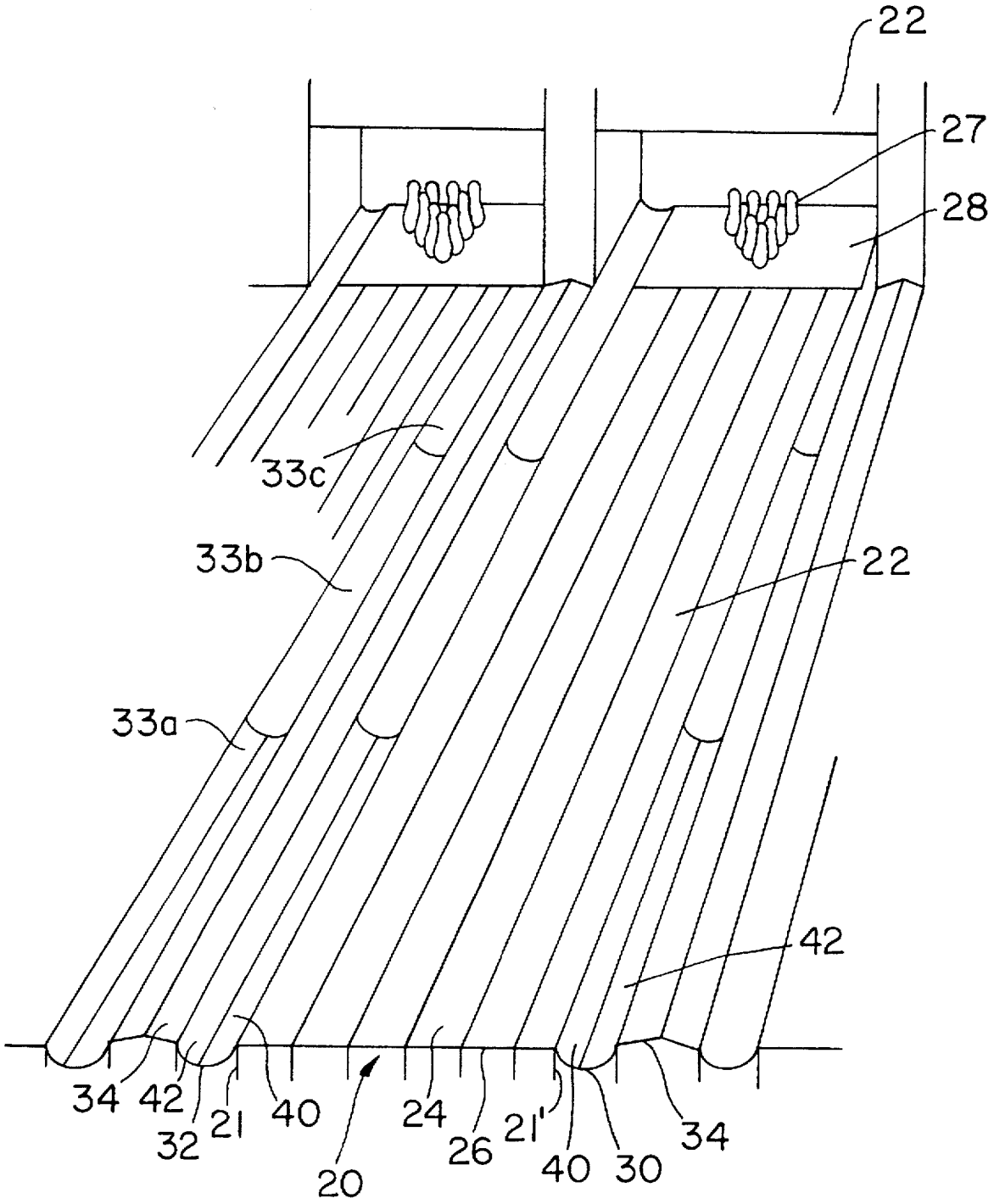
FIG. 1 is a perspective view of a bowling alley bumper system in accordance with a first embodiment of the invention, and wherein the bumpers are shown in the recessed, or retracted, position.

As illustrated in FIG. 1, a bowling alley 10 typically includes a longitudinally extending lane 20 which defines a flat horizontal plane on an upper surface thereof and which is typically made up of a plurality of parallel abutting strips of wood 22, 24. The alley includes a foul line 26 which extends across the lane 20 and perpendicular to the longitudinal axis of the lane. The foul line 26 indicates that area beyond which a bowler may not pass in releasing a bowling ball during a game of bowling. A pin deck 28 is disposed at the opposite end of the lane 20 and is adapted to receive a plurality of bowling pins 27 thereon. As shown in FIG. 1, the bowling alley is set with the pins in a customary triangular pattern with one pin, the head pin, in front, a second row of two pins, a third row with three pins and a final row of four pins.

A pair of longitudinally-extending gutters 30, 32 are disposed along the side of the lane 20 with one gutter on each side of lane 20 in a customary manner, i.e., adjacent to and in abutting relationship with the lane. The gutters 30, 32 are adapted to receive any balls that are bowled toward one side of the lane and to direct any misdirected balls to the end of the alley. Also illustrated are capping members 34 which separate the adjacent alleys or lanes.

Figure 2:
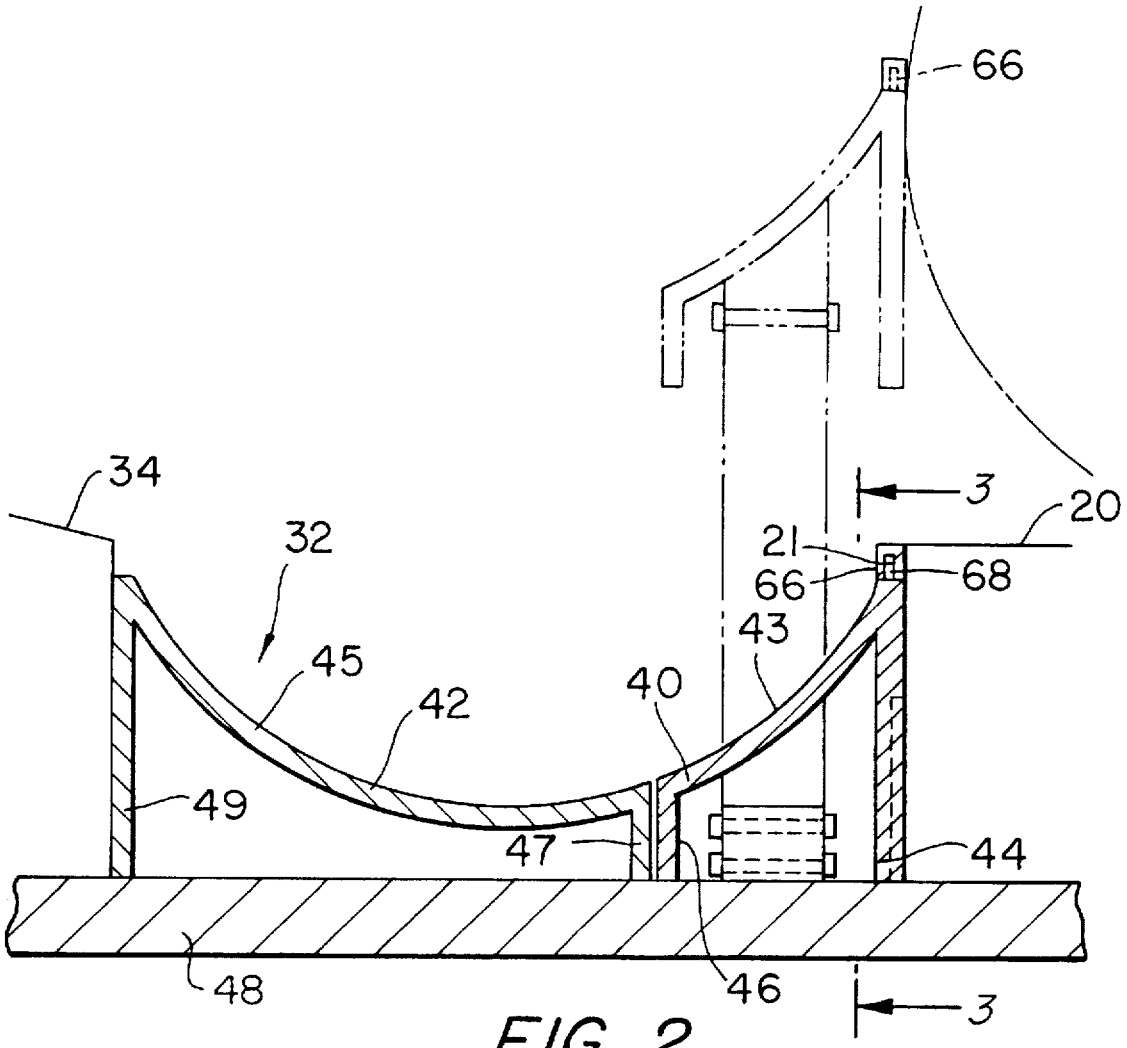
FIG. 2 is an end view of a portion of the bowling alley bumper system shown in FIG. 1, but with a bumper system shown in its extended, or operative, position by broken lines.
Figure 3:
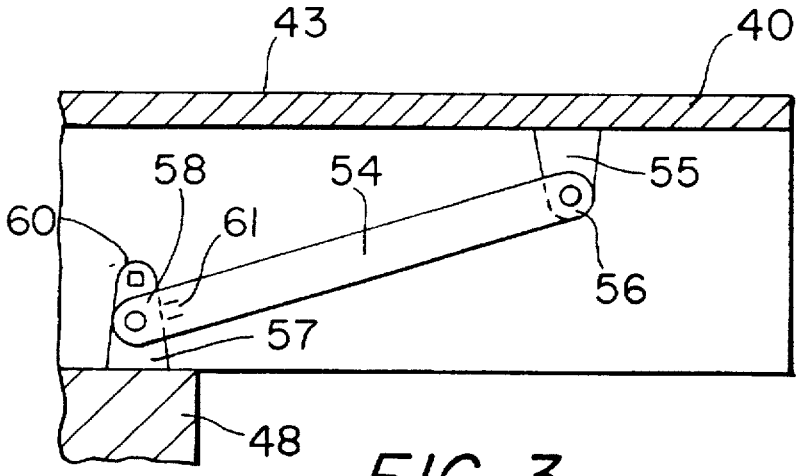
FIG. 3 is a cross-sectional view taken along 3—3 in FIG. 2.

The mechanism for bumper bowling is illustrated more clearly in FIGS. 2 and 3. As illustrated therein, a bumper bowling system is incorporated in the bowling alley 10 which includes two sides 21, 21' and a longitudinally extending lane 20 on an upper surface thereof. Each of the gutters 30, 32 defines first and second concave, longitudinally extending portions 40, 42. The first portion 40 defines an arc-shaped concave surface 43 which forms a part of the gutter 32 and forms about one-third of the gutter when viewed in cross section. The portion 40 also includes a pair of downwardly extending projections 44, 46 which are preferably parallel to one another. The projections 44, 46 support the portion 40 on a suitable base such as a plurality of cross members 48. The first projection 44 is adjacent to and abuts side 21 and is constructed and arranged to slide upwardly therealong, as will be described hereinafter. The projection 44 may also include a resilient bumper 44' recessed thereon for engaging a bowling ball which is directed toward the bumper.

The second longitudinally extending portion 42 also defines an arc-shaped concave surface 45 which forms the outer two-thirds of gutter 32. The portion 45 also includes a pair of downwardly extending parallel projections 47, 49. The projections 47, 49 are fixed to the cross member 48 in a customary manner with a first of the projections 47 adjacent to and abutting projection 46. The second projection 49 is adjacent to and abutting capping member 34 which separates a pair of alleys.

For conventional bowling, the longitudinally extending portions 40 are positioned in the lower or retracted position shown in FIGS. 1 and 2. However, when it is desired to convert the lane to bumper bowling as described by the aforementioned patent of Stephens, the portion 40 is raised upwardly along an arc. The portion 40 is moved upwardly by means of a crank arm 54 and a pair of swivel connecting elements 56 and 58 to the position shown by the broken lines in FIG. 2. The swivel connecting elements 56 and 58 are operatively connected to the bottom of portion 40 in a conventional manner such as a bracket 55 and to the cross member 48 by means of a bracket 57. Locking means, such as projection 60 and detent 61 or other suitable mechanisms, may also be provided for maintaining the bumper in an elevated position.

Figure 4:
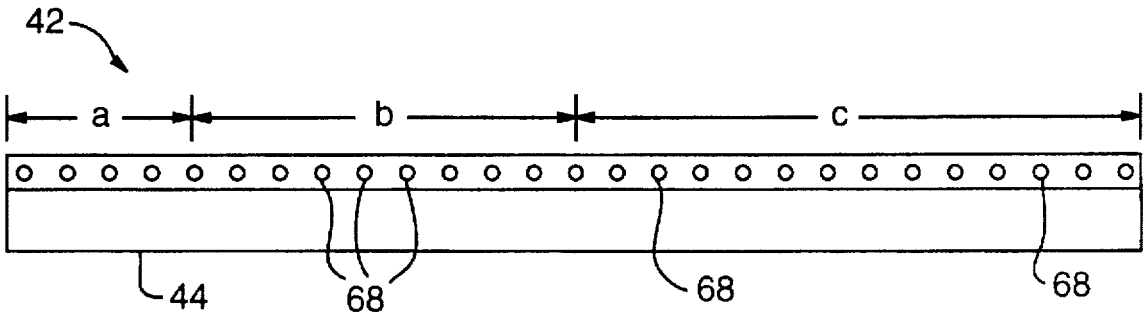
FIG. 4 is a side elevational view of a bowling alley bumper which includes a plurality of lights in accordance with one embodiment of the invention.

FIG. 4 shows the position of a clear plastic rail 66 which is disposed on an upper portion 67 of the longitudinal extension 42 immediately above the downward extending projection 44. The clear plastic rail 66 may comprise an extrusion of PVC or other suitable material. The rail 66 also defines a longitudinally extending passageway for receiving a light string, which includes a plurality of lights, or bulbs, 68. The bulbs 68 may be incandescent bulbs or LED's, with the latter being preferred. The LED's are preferred, because they draw less current and produce less heat. As illustrated, the rail 66 is in an upper portion of projection 44; however, it is presently contemplated that the rail 66 may be included in an intermediate or lower portion thereof.

The bulbs 68 are preferably spaced at between two to five inches on center. For example, in a first embodiment of the invention, the lights are equally spaced by a distance of about three inches. In a preferred embodiment of the invention, the lights in a first portion a. of the rail 66 are approximately three inches apart, while the spacing in portions b. and c. are four and five inches, respectively. For example, in the first 18-foot, 8-inch section of a bumper, all of the bulbs are spaced three inches apart. In the second 18-foot, 8-inch section, the lights are four inches apart, and in the third 18-foot, 8-inch section, the bulbs are five inches apart.

In another embodiment of the invention, a string of clear and/or amber color lights is inserted into a flexible extrusion (not shown). The flexible extrusion may, for example, be red, blue, green, yellow, or clear and would be of a suitable size to slide in and out of the passageway formed by rail 66. In this way, lights or bulbs 68 of an entire string can be readily changed.

In a preferred embodiment of the invention, lights or bulbs 68 are disposed in three circuits. For example, an overall circuit 70, as shown schematically in FIG. 5, includes a power source (not shown). The power source for the light string is preferably a 24-VAC (volt AC) or 24-VDC (volt DC) system. If DC is used, it should be unfiltered and full-wave rectified. In either case, a single light string will require less than 3.5 amps, with all of the lights or bulbs 68 illuminated. The circuit 70 for each string of lights also includes three light circuits. For example, each string of lights includes four conductors or wires 73, 74, 75 and 76, with one wire 76 for common power, and the other wires 73, 74, and 75, each of which includes a plurality of bulbs 68, acting as returns.

Figure 5:
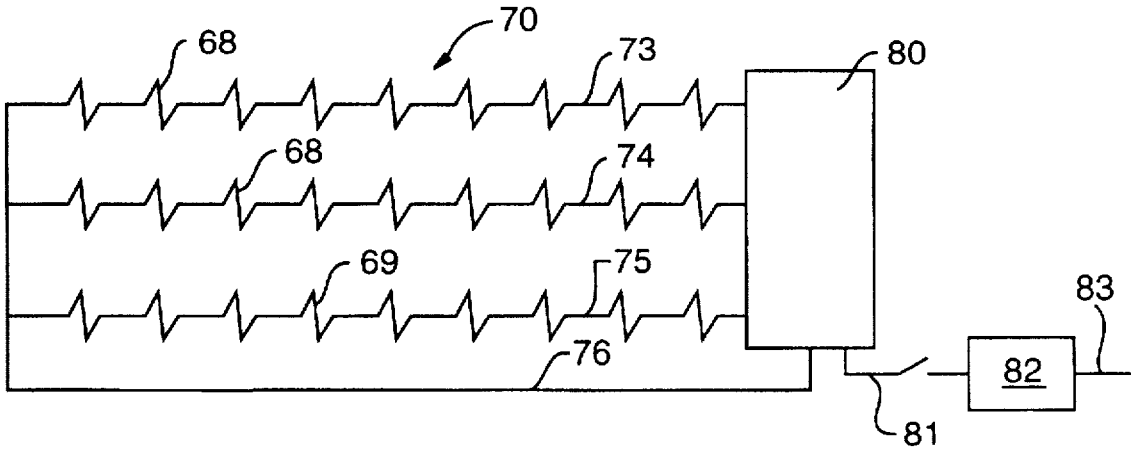
FIG. 5 is a schematic diagram of an electrical circuit for pulsating the lights in a bumper system in accordance with the invention.

The bulbs 68 are disposed in the three light circuits, with every third light on the same light circuit. For example, the first, fourth, seventh, etc., lights are disposed in the first light circuit along the conductor or wire 73, as shown in FIG. 5. The second, fifth, eighth, etc., lights are in the second light circuit along the conductor or wire 74, and the third, sixth, ninth, etc., lights (bulbs 68) are in the third light circuit along the conductor or wire 75.

Means, such as a controller 80, alternate the power between the three light circuits to turn the lights in each light circuit on and off to produce the novel visual effects. The controller 80, which includes a power source, may take the form of a timing circuit, oscillator circuit, sequencer or computer, all of which are well within the skill of a person of ordinary skill in the art. This controller 80 is then used to produce a "chase" effect, i.e., the lights appear to chase up and down the alley, preferably toward the pin deck end of the alley, as, for example, in the same direction of a bowling ball as it is rolled down the alley.

In a further embodiment of the invention, a sound synchronizer 82 is used to flash the lights on and off to music. The synchronizer 82, which is preferably a computer including software which may or may not be built in the controller 80, is connected by switch 81 to a stereo system, public address system, or juke box (not shown) by conductor 83. Computer programs and/or circuits for synchronizing lights to music are well known and well within the capabilities of a person of ordinary skill in the art.

Figure 6:
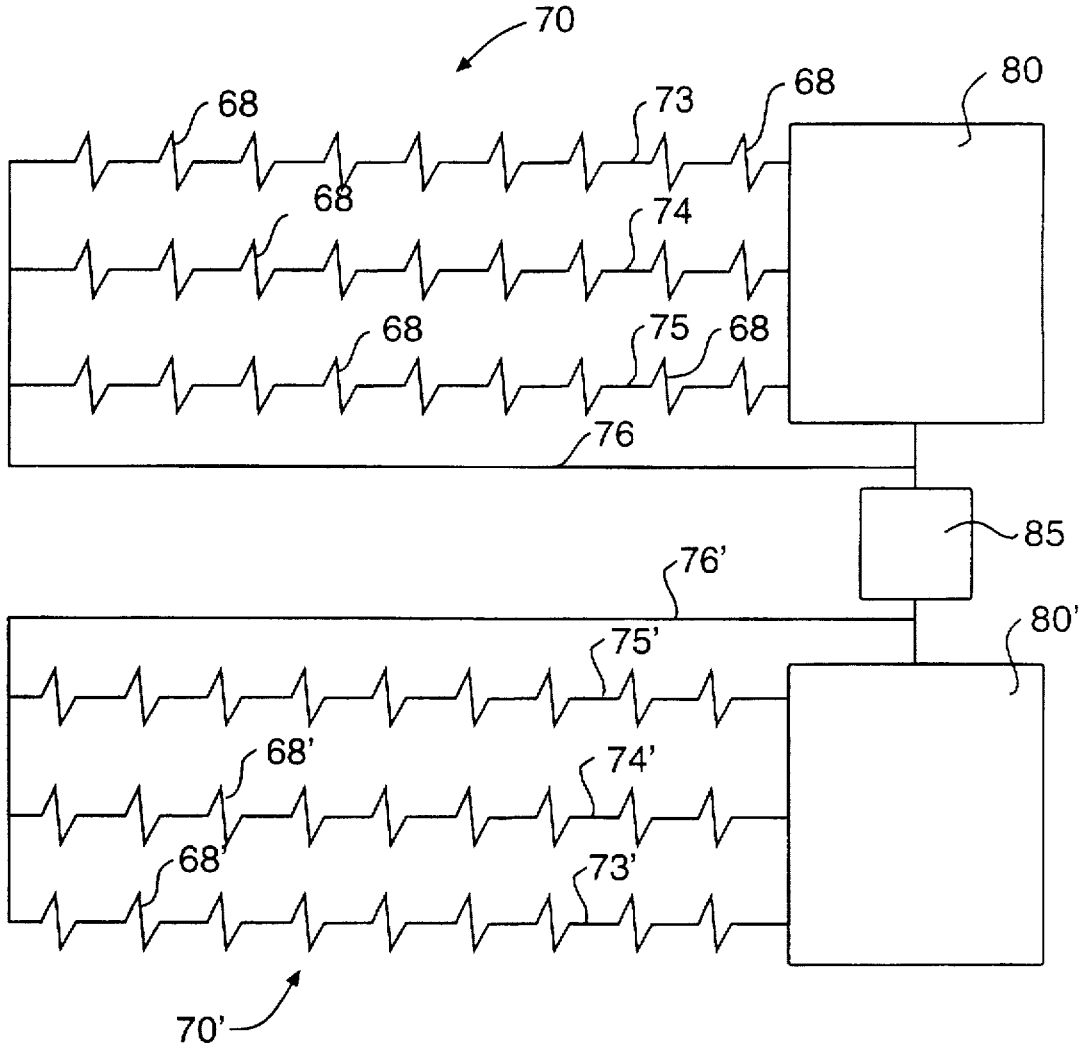
FIG. 6 is a schematic diagram of an electrical circuit for illuminating a plurality of lights along a first alley and a plurality of lights along a second adjacent alley.

At times, it may also be desirable to provide a master controller 85 (see FIG. 6) to control all of the strings of light in a plurality of adjacent lanes. In FIG. 6, two strings of lights are illustrated. For example, circuits 70 and 70' each controls a single string of lights in adjacent lanes. The lights 68 in a first string are, for example, disposed along the wires 73, 74 and 75, which receive power from the source through the conductor or wire 76. An adjacent string of lights 68' is disposed along conductors or wires 73', 74' and 75', which receive power from a source through conductor 76'. The controller 85 is then used to produce a "spin" effect, or a "chase" between lanes. This feature creates a wave effect with lights chasing across the bowling center. For example, lane 1 would blink, then lane 2, lane 3 and lanes 4, 5 and 6; then back from lane 6, lane 5, lane 4, 3, 2 and 1, to create a novel visual effect.

It should also be noted that the lights may be used with the bumpers in the extended or retracted position, and that the novel visual effects can be produced under normal or under the so-called "moon-lit" lighting. It should also be noted that there are other bumper mechanisms than the one disclosed above, and that the present invention is applicable to such other bumper systems.

While the invention has been described in connection with its preferred embodiment, it should be recognized that changes and modifications may be made therein without departing from the scope of the following claims.

What is claimed is:

1. A bowling alley including a longitudinally extending lane having two laterally spaced sides and a concave gutter adjacent to each of said two sides of said lane and a bumper system for guarding said gutters and for producing visual effects along the length of said longitudinally extending lane, said bumper system including a pair of longitudinally extending bumpers disposed along the length of said gutters, and means for moving said bumpers between a first or guarding position to thereby prevent a bowling ball from falling into said gutters and a recessed, or retracted position for ordinary bowling, each of said bumpers including a longitudinally extending clear plastic rail having a longitudinally extending passageway extending therethrough and a string of lights disposed within said passageway and extending along said bumper, said clear plastic rail forming an upper most portion of said bumpers when in said first or guarding position and said upper most portion generally flush with said lane when said bumpers are in a recessed or retracted position, and means for pulsating said lights to produce a visual effect along the length of said lane.

2. A bowling alley in accordance with claim 1 in which said means for pulsating said lights includes a plurality of circuits.

3. A bowling alley according to claim 2 in which each of said bumpers includes a contact area for contact by a bowling ball and a non-contact area and in which said plurality of lights are disposed in said non-contact area.

4. A bowling alley according to claim 3 in which said plurality of lights are LED's.

5. A bowling alley according to claim 3 in which said plurality of lights are incandescent lights.

6. A bowling alley according to claim 3 in which said bumpers on each side of the alley include a string of about 170–225, generally equally-spaced, lights.

7. A bowling alley in accordance with claim 6 in which each string of lights includes three circuits, with every third light on the same circuit.

8. A bowling alley in accordance with claim 7 in which each string of lights includes four conductors, including one for common power and the other three for the return of the three circuits.

9. A bowling alley in accordance with claim 8 in which each of said strings of lights draws sufficient current to illuminate all of said lights, and in which said current is less than 3.5 amps.

10. A bowling alley in accordance with claim 2 in which said means for pulsating said lights includes means for sequentially illuminating said lights to produce a "chase" effect along the alley.

11. A bowling alley according to claim 2 which includes means for synchronizing the pulsating means to music.

12. A plurality of side-by-side bowling alleys, each of which includes a longitudinally extending lane having two laterally spaced sides and a concave gutter adjacent to each of said two sides of said lane and a bumper system for guarding said gutters, and for producing visual effects along the length of said longitudinally extending lane, each of said bumper systems including a pair of longitudinally extending bumpers disposed along the length of said gutters and means for moving said bumpers between an extended or guarding position to thereby prevent a bowling ball from falling into said gutters, and a recessed or retracted position for ordinary bowling, each of said bumpers including a longitudinally extending clear plastic rail having a longitudinally extending passageway extending therethrough and a string of lights disposed within said passageway and extending along said bumpers, said clear plastic rail disposed on and forming an upper most portion of said bumper when in said first or guarding position and generally flush with said lane when said bumper is in a recessed or retracted position, and control means for controlling the pulsating of said lights in a plurality of adjacent alleys to thereby produce a wave effect from alley to alley.

13. A plurality of side-by-side bowling alleys in accordance with claim 12, in which each of said bumpers includes a contact area for contact by a bowling ball and a non-contact area and in which said lights are disposed in said non-contact area.

14. A plurality of side-by-side bowling alleys in accordance with claim 13, in which each of said bumpers includes a string of about 150 LED lights, and which each string of lights includes three circuits, with every third light on the same circuit.

15. A plurality of side-by-side bowling alleys in accordance with claim 14, in which said means for pulsating said lights in each string of lights includes means for sequentially illuminating said lights to thereby produce a chase effect.

16. A plurality of side-by-side bowling alleys according to claim 14 which includes means for synchronizing the pulsating means to music.

17. A bowling alley bumper system in accordance with claim 3 in which the bumpers on each side of the alley include a string of about 170–225 LED lights and wherein said lights along a first portion of a bumper are generally equally spaced, said lights in a second portion of said bumper are generally equally spaced but separated from one another by a greater distance than said lights in said first portion, and wherein said lights in a third portion along said bumper are generally equally spaced but separated from one another by a greater distance than said lights in said second portion.

18. A bowling alley bumper system according to claim 6 which includes means for controlling the illumination of the lights in each string of lights independently of the other string.

* * * * *